US009016679B2

(12) United States Patent
Kunieda et al.

(10) Patent No.: US 9,016,679 B2
(45) Date of Patent: Apr. 28, 2015

(54) SHEET PROCESSING APPARATUS AND IMAGE FORMING SYSTEM

(71) Applicants: Akira Kunieda, Tokyo (JP); Tomohiro Furuhashi, Kanagawa (JP); Shuuya Nagasako, Kanagawa (JP); Michitaka Suzuki, Kanagawa (JP); Kazuya Yamamoto, Kanagawa (JP); Kyosuke Nakada, Kanagawa (JP); Takahiro Watanabe, Kanagawa (JP); Yuuji Suzuki, Kanagawa (JP); Kiichiro Goto, Kanagawa (JP)

(72) Inventors: Akira Kunieda, Tokyo (JP); Tomohiro Furuhashi, Kanagawa (JP); Shuuya Nagasako, Kanagawa (JP); Michitaka Suzuki, Kanagawa (JP); Kazuya Yamamoto, Kanagawa (JP); Kyosuke Nakada, Kanagawa (JP); Takahiro Watanabe, Kanagawa (JP); Yuuji Suzuki, Kanagawa (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/089,868

(22) Filed: Nov. 26, 2013

(65) Prior Publication Data

US 2014/0147184 A1 May 29, 2014

(30) Foreign Application Priority Data

Nov. 27, 2012 (JP) ..... 2012-258980

(51) Int. Cl.

| | |
|---|---|
| ***B31F 1/10*** | (2006.01) |
| ***B65H 45/14*** | (2006.01) |
| ***B31F 1/00*** | (2006.01) |
| *G03G 15/00* | (2006.01) |
| *B65H 45/20* | (2006.01) |

(52) U.S. Cl.

CPC ..... *B65H 45/147* (2013.01); *G03G 15/6582* (2013.01); *B31F 1/10* (2013.01); *B31F 1/0025* (2013.01); *B65H 45/20* (2013.01); *G03G 2215/00877* (2013.01)

(58) Field of Classification Search

CPC ..... B31F 1/10; B31F 1/0025; B65H 45/20; B65H 45/147

USPC ..... 270/32, 39.01; 493/416, 419, 434, 435, 493/421, 440, 442

See application file for complete search history.

(56) References Cited

U.S. PATENT DOCUMENTS

| | | | | |
|---|---|---|---|---|
| 5,364,332 | A * | 11/1994 | Gray, Jr. | 493/23 |
| 6,648,319 | B2 * | 11/2003 | Chapman | 270/45 |
| 6,719,680 | B2 * | 4/2004 | Hosoya et al. | 493/324 |
| 6,730,010 | B2 * | 5/2004 | Yamakawa et al. | 493/267 |
| 7,052,005 | B2 * | 5/2006 | Yamakawa et al. | 270/37 |

(Continued)

FOREIGN PATENT DOCUMENTS

| | | |
|---|---|---|
| JP | 2004-284742 | 10/2004 |
| JP | 2011-057363 | 3/2011 |

*Primary Examiner* — Leslie A Nicholson, III

(74) *Attorney, Agent, or Firm* — Harness, Dickey & Pierce, P.L.C.

(57) ABSTRACT

A sheet processing apparatus includes: a folding processing unit that folds a sheet by reversely rotating a second conveying member in a condition in which the sheet is held by a first and the second conveying members; a calculating unit that calculates an amount of deflection of the sheet held by the first and second conveying members from timings at which the sheet is detected by first and second detecting units disposed upstream of the first conveying member and downstream of the second conveying member and a distance between disposed positions of the first and second detecting units; and a control unit that sets, from the calculated amount of deflection of the sheet, an amount of conveyance for the first conveying member in a direction opposite to a sheet conveying direction in a condition in which the sheet is held by the first and second conveying members.

8 Claims, 7 Drawing Sheets

(56) References Cited

U.S. PATENT DOCUMENTS

| | | | | |
|---|---|---|---|---|
| 7,077,393 | B2 * | 7/2006 | Ishida | 270/37 |
| 7,712,732 | B2 * | 5/2010 | Horii et al. | 270/32 |
| 2004/0185993 | A1 * | 9/2004 | Doi | 493/231 |
| 2009/0062100 | A1 | 3/2009 | Takekawa et al. | |
| 2011/0190109 | A1 | 8/2011 | Kimata | |
| 2011/0221125 | A1 | 9/2011 | Kimata | |

* cited by examiner

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2012-258980 filed in Japan on Nov. 27, 2012.

BACKGROUND OF THE INVENTION

1. Field of the Invention

The present invention relates to a sheet processing apparatus and an image forming system, and more particularly to a binding processing mechanism intended for sheets such as sheets of paper after image forming.

2. Description of the Related Art

On sheets such as sheets of paper printed out by an image forming apparatus such as a copying machine and a printer or a printing machine, post-processing such as a binding process by a stapler to bind a part of a given number of sheets in the condition in which the sheets are gathered may be performed other than being ejected from the image forming apparatus. As an apparatus for this purpose, a sheet processing apparatus connected to an ejecting unit of the image forming apparatus is used.

What performed by the sheet processing apparatus includes not only a binding process aimed for a corner of the leading end of the ejected sheets in the ejecting direction or one side thereof and a saddle stitching process that binds the center of the sheet of paper, but also a folding process that doubles up the saddle-stitched sheets at the saddle-stitched portion for bookbinding.

As a configuration to perform folding work, a known configuration includes a conveying roller that conveys a sheet being a target of the folding work, and a stopper member against which the leading end of the sheet is pressed and stopped (for example, Japanese Patent Application Laid-open No. 2004-284742).

In this configuration, a process of folding a buckling-deformed portion of the sheet, which is formed when the sheet is further conveyed in the condition in which the leading end of the sheet abuts the stopper member, when clamping and conveying the buckling-deformed portion by the conveying roller is repeated.

Meanwhile, as a process prior to performing the folding work, a creasing process may be performed.

As one of the configurations used for creasing work, a configuration is disclosed in which a member having a projecting tooth and a pedestal facing the member are disposed across the conveying path of the sheet of paper (for example, Japanese Patent Application Laid-open No. 2011-057363).

In this configuration, moving the member having the projecting tooth towards the pedestal creases the sheet.

When creasing is performed, the creasing positions of respective sheets may deviate from one another if the position of the creasing work is not appropriate. If the positions of creasing deviate from one another, the folding positions of the sheets deviate and the advantageous effect of creasing is not sufficiently obtained when the folding work such as half hold is performed. Furthermore, when the sheets are matched at the creasing positions that deviate from one another, there arises a problem that the ends of the sheets after folding work do not align with one another.

Consequently, in the configuration disclosed in Japanese Patent Application Laid-open No. 2011-057363, the configuration is disclosed in which the conveyance of the sheet is stopped before the sheet reaches the folding unit in the condition in which the sheet is clamped at the part near the leading end of the sheet positioned downstream in the sheet conveying direction, and rotates the conveying roller on the upstream side in the sheet conveying direction in reverse to exert a tensile force to the sheet so as to eliminate the deflection.

In the configuration disclosed in Japanese Patent Application Laid-open No. 2011-057363, however, being not able to exert the tensile force corresponding to the amount of deflection of the sheet causes the following flaw.

That is, the deflection occurs when the leading end of the sheet is pressed against and stopped by a pair of rollers positioned on the downstream side in the conveying direction. Consequently, the deflection remains at the position before the position clamped by the pair of rollers when the sheet is conveyed until the downstream side of the sheet in the conveying direction is detected. The amount of the deflection varies greatly depending on the curl condition (magnitude of curl) and the bending stiffness of the leading end of the sheet of paper.

Consequently, even when the conveying roller is rotated in reverse to generate the tensile force to the sheet, it may result in that the deflection remains not eliminated, that the durability of the conveying rollers deteriorates due to an increase in the amount of slip, or the like when the amount of reverse rotation is far different from the amount of actual deflection.

As for the amount of deflection, whether to perform skew correction also makes it vary greatly. More specifically, in the skew correction in which conveying is continued on the upstream side in the conveying direction while the sheet is pressed against and stopped by a pair of rollers, the amount of deflection is likely to increase unlike when the skew correction is not performed. Thus, unless the correction corresponding to the amount of deflection is performed properly, the position of creasing may not be calculated accurately.

In view of the above, there is a need to provide a sheet processing apparatus and an image forming system that can make the creasing position of the sheet even between the sheets with a simple configuration regardless of the difference in the amount of deflection.

SUMMARY OF THE INVENTION

It is an object of the present invention to at least partially solve the problems in the conventional technology.

A sheet processing apparatus includes: a first conveying unit that includes a pair of members to convey a sheet; a second conveying unit that includes a pair of members to receive the sheet conveyed by the first conveying unit and conveying the sheet to a subsequent stage; a folding processing unit that folds the sheet by rotating the second conveying member in a reverse direction in a condition in which the sheet is held by the first conveying member and the second conveying member; a first detecting unit that is disposed upstream of the first conveying member in a sheet conveying direction and detects an end portion of the sheet; a second detecting unit that is disposed downstream of the second conveying member in the sheet conveying direction and detects an end portion of the sheet; a calculating unit that calculates an amount of deflection of the sheet held by the first conveying member and the second conveying member from timings at which the sheet is detected by the first detecting unit and the second detecting unit and a distance between disposed positions of the first detecting unit and the second detecting unit; and a control unit that sets, from the calculated amount of deflection of the sheet, an amount of conveyance for the first conveying member in a direction opposite to the sheet conveying direction in a condition in which the sheet is held by the first conveying member and the second conveying member.

An image forming system includes: a sheet processing apparatus as described above; an image forming apparatus; and a post-processing apparatus. The image forming apparatus is connected as an upstream apparatus with respect to the first conveying unit and the post-processing apparatus is connected as a downstream apparatus with respect to the second conveying unit with a position in which creasing of the sheet is performed as a boundary.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

With examples illustrated in the accompanying drawings, an embodiment of the present invention will be explained below.

Figure 1:
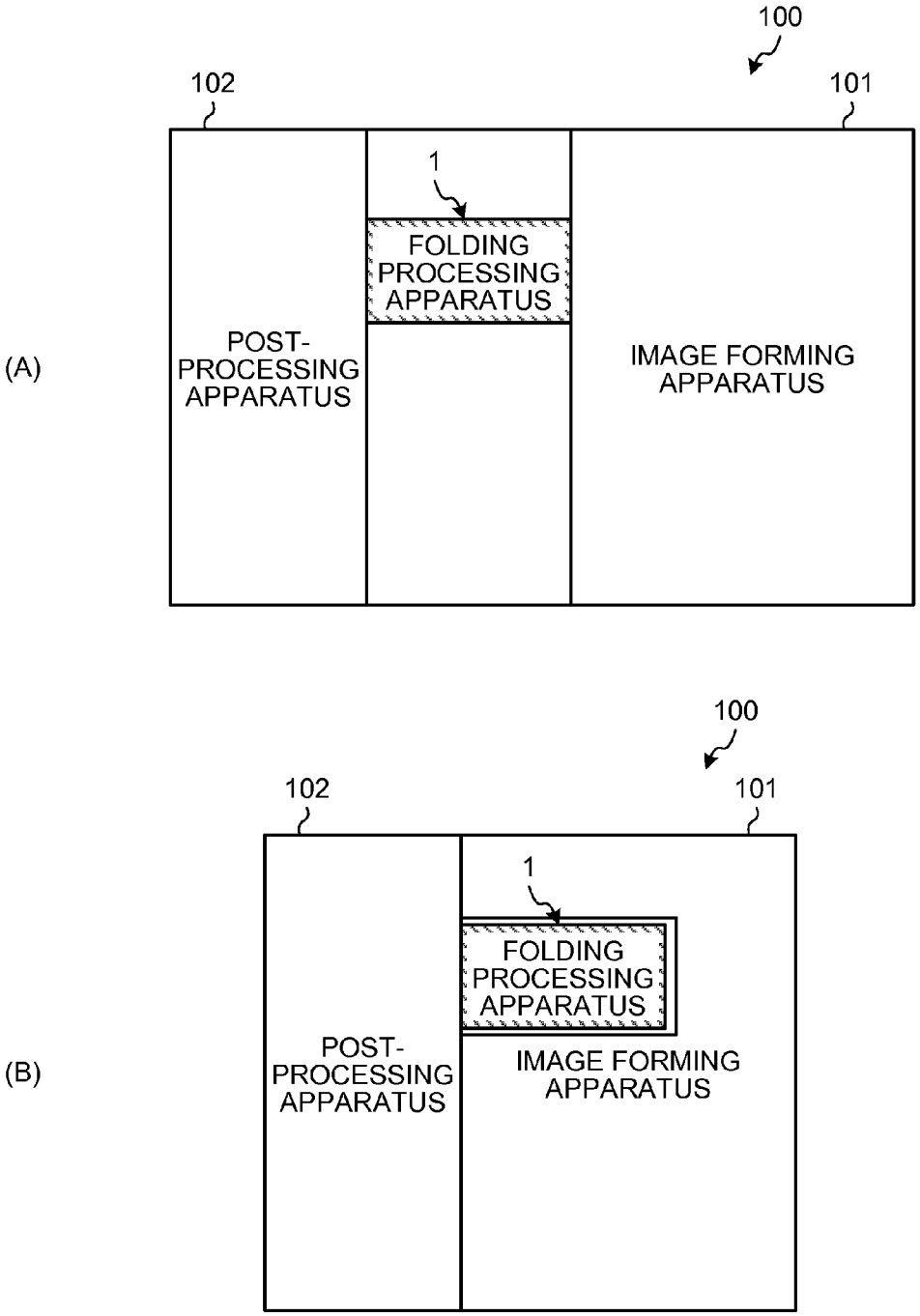
FIG. 1 is a schematic diagram for explaining image forming systems that use one example of a sheet processing apparatus according to an embodiment of the invention.

FIG. 1 is a schematic diagram for explaining image forming systems that use one example of a sheet processing apparatus according to the embodiment.

In FIG. 1, in an image forming system 100, an image forming apparatus 101 is connected as an upstream apparatus on the upstream side in a sheet conveying direction with respect to a sheet processing apparatus 1 that has a creasing position which will be described later, and a post-processing apparatus 102 is connected as a downstream apparatus on the downstream side in the sheet conveying direction.

The image forming apparatus 101 is an apparatus that uses electrophotography as an example, and the post-processing apparatus 102 is a folding machine that performs folding work on sheet bundles that are creased or a stapling machine that binds the sheet bundles after the folding work. In the present embodiment, the sheet processing apparatus is configured to perform folding work as described later, and thus the downstream apparatus corresponds to the stapling machine that is one of the post-processing apparatuses.

FIG. 1(A) illustrates an example in which the sheet processing apparatus 1 is connected at the sheet ejecting position of the image forming apparatus 101. FIG. 1(B) illustrates an example in which the sheet processing apparatus 1 is incorporated at the sheet ejecting position inside the image forming apparatus 101 and the post-processing apparatus 102 is connected at a sheet ejecting unit of the sheet processing apparatus 1.

Figure 2:
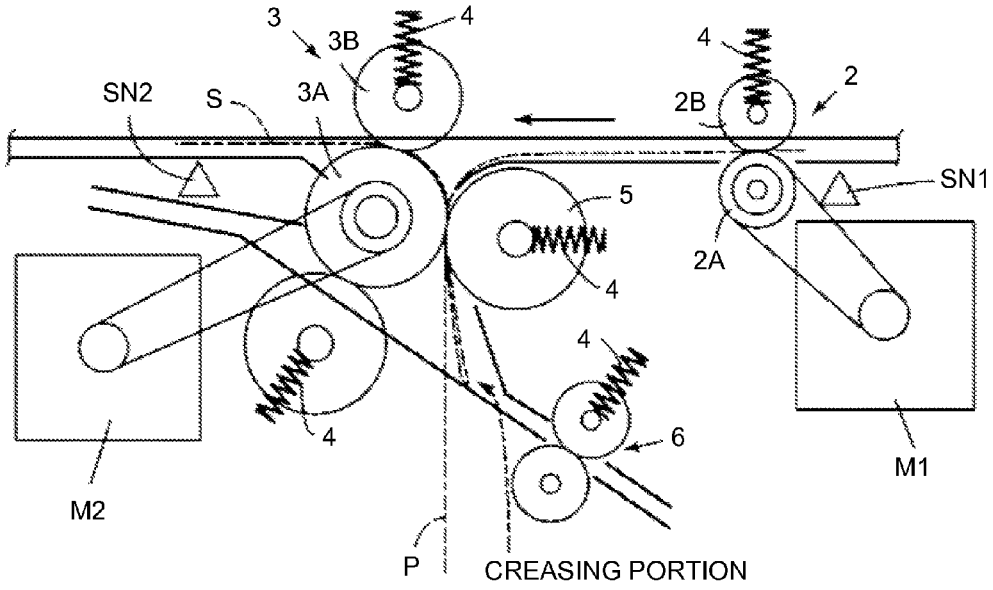
FIG. 2 is a schematic diagram for explaining the configuration of the one example of the sheet processing apparatus in the embodiment.

FIG. 2 is a diagram illustrating a relevant portion of the sheet processing apparatus 1 in the embodiment.

In FIG. 2, the sheet processing apparatus 1 is used as an apparatus to perform creasing on a plurality of sheets. The sheet processing apparatus 1 is disposed at a conveying path extending from the image forming apparatus 101 towards the stapling machine used as the downstream apparatus 102. Consequently, a dedicated conveying path for the creasing process is not specially provided, and thus the occupying space of the image forming system can be prevented from being expanded.

The sheet processing apparatus 1 includes a first conveying unit 2 that is positioned on the upstream side in the conveying direction of a sheet S indicated by the arrow with a creasing position indicated by the symbol P as a boundary, and is capable of conveying the sheet. The sheet processing apparatus 1 further includes a second conveying unit 3, which is capable of conveying and clamping the sheet, on the downstream side in the conveying direction of the sheet S.

Each of the first and the second conveying units 2 and 3 uses a pair of rollers facing across the conveying path of the sheet S, and rollers 2A and 3A of ones of the respective pairs are configured to be moved by driving motors M1 and M2, respectively, in normal and reverse directions, that is, rotated in normal and reverse directions.

The pairs of rollers 2 and 3 are maintained in a condition in which they can clamp and convey the sheet, using elastic bodies 4 disposed at rollers 2B and 3B, respectively, of the other ones of the respective pairs.

The sheet processing apparatus 1 includes a third conveying unit 5 as a unit for when the creasing work is performed for folding work, other than when the sheet S is conveyed using the above-described first conveying unit 2 and the second conveying unit 3 when the sheet S is ejected without performing creasing work.

The third conveying unit 5 can move together with the second conveying unit 3, and more specifically, the third conveying unit 5 uses a roller that faces the one roller 3A of the second conveying unit 3 and can clamp the sheet S.

The creasing work using the third conveying unit 5 is performed by pressing a part of the sheet S stopped in the conveying path of the sheet S, in which the first and the second conveying units 2 and 3 are used, into a conveying path which the third conveying unit 5 that can move together with the one roller 3A of the second conveying unit 3 faces.

More specifically, after the downstream side of the sheet S in the sheet conveying direction is pressed and stopped in the conveying path of the sheet S formed by the first and the second conveying units 2 and 3, the second conveying unit 3 is rotated in reverse to introduce a part of the sheet S into the position at which it faces the third conveying unit 5.

Consequently, as illustrated by a dashed-two dotted line in FIG. 2, a part of the sheet S is deflection-deformed and a folded portion is introduced into the creasing conveying path (the position indicated by the symbol P in FIG. 2), in which the one roller 3A of the second conveying unit 3 and the third conveying unit 5 face each other, whereby the crease is formed.

In the present embodiment, the second conveying unit 3 and the third conveying unit 5 that face each other at the creasing conveying path P are used as the members constituting a folding unit.

Other than the third conveying unit 5, an ejecting roller 6 faces the one roller 3A of the second conveying unit 3 to eject the sheet S that is introduced into the creasing conveying path P to be subjected to the creasing work.

For drawing in and ejecting the sheet S introduced into the creasing conveying path P, a pair of auxiliary ejecting rollers 7 is also used in addition to the above-described ejecting roller 6.

Meanwhile, at the conveying path of the sheet S at which the first and the second conveying units 2 and 3 are disposed, a first sheet detecting unit SN1 and a second sheet detecting unit SN2 that can detect the respective passing timings of the sheet S are disposed on the upstream side and on the downstream side, respectively, in the sheet conveying direction.

The first sheet detecting unit SN1 is positioned upstream of the first conveying unit 2 in the conveying direction, and the second sheet detecting unit SN2 is positioned downstream of the second conveying unit 3 in the conveying direction.

Figure 3:
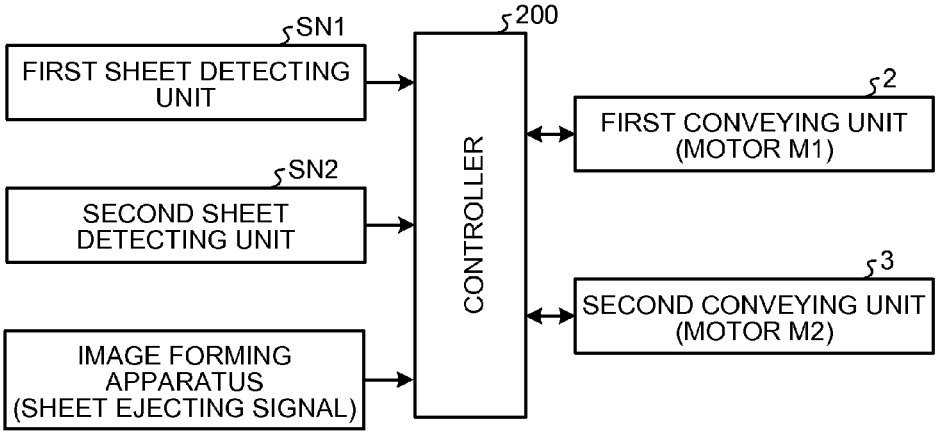
FIG. 3 is a block diagram for explaining the configuration of a controller used in the sheet processing apparatus illustrated in FIG. 2.

The first and the second sheet detecting units SN1 and SN2 are connected to the input side of a controller 200 illustrated in FIG. 3.

The controller 200 is a portion that performs conveyance control of the sheet, and in the embodiment, the conveyance control includes elimination of deflection of the sheet S, which occurs in the course of conveyance, and skew correction as the object of control. In particular, the controller 200 is a member that can control the respective timings of the movement of the first conveying unit 2 in the normal and reverse directions and the stoppage of the conveyance of the second conveying unit.

On the controller 200, the sheet detecting units SN1 and SN2 are connected on the input side while the driving motors M1 and M2 for the first and the second conveying units 2 and 3, respectively, are connected on the output side. The controller 200 is further configured to receive a sheet ejecting signal from the image forming apparatus 101 that corresponds to the upstream apparatus. This is used as a signal to set the timing of activating the sheet processing apparatus 1.

The controller 200 gives instructions to rotate the second conveying unit 3 in reverse when creasing is made by the folding unit, and performs a process to eliminate the deflection by calculating the amount of deflection of the sheet S and by setting the amount of reverse rotation for the first conveying unit 2 in response to the amount of deflection.

More specifically, the first and the second sheet detection timings are compared with the reference timings based on the distance between the disposed positions of the first and the second sheet detecting units SN1 and SN2, and the amount of deflection is calculated from the difference of the actual detection timings to the reference timings.

FIGS. 4 to 8 are diagrams for explaining a process in which deflection is formed in the sheet S when skew correction is not performed. In FIGS. 4 to 8, the conveying speed of the sheet S is assumed not to vary.

Figure 4:
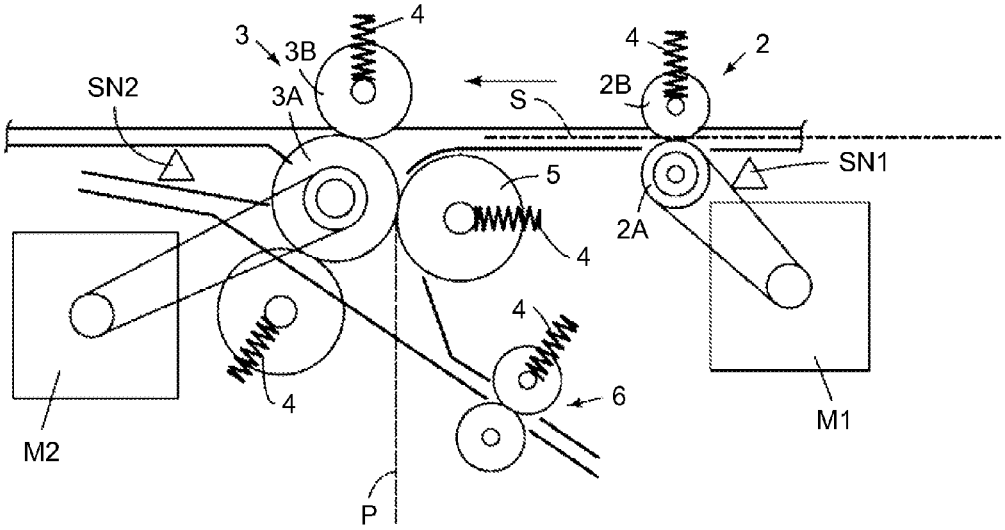
FIG. 4 is a schematic diagram illustrating a condition of a sheet being conveyed by a first conveying unit in the sheet processing apparatus illustrated in FIG. 2.
Figure 5:
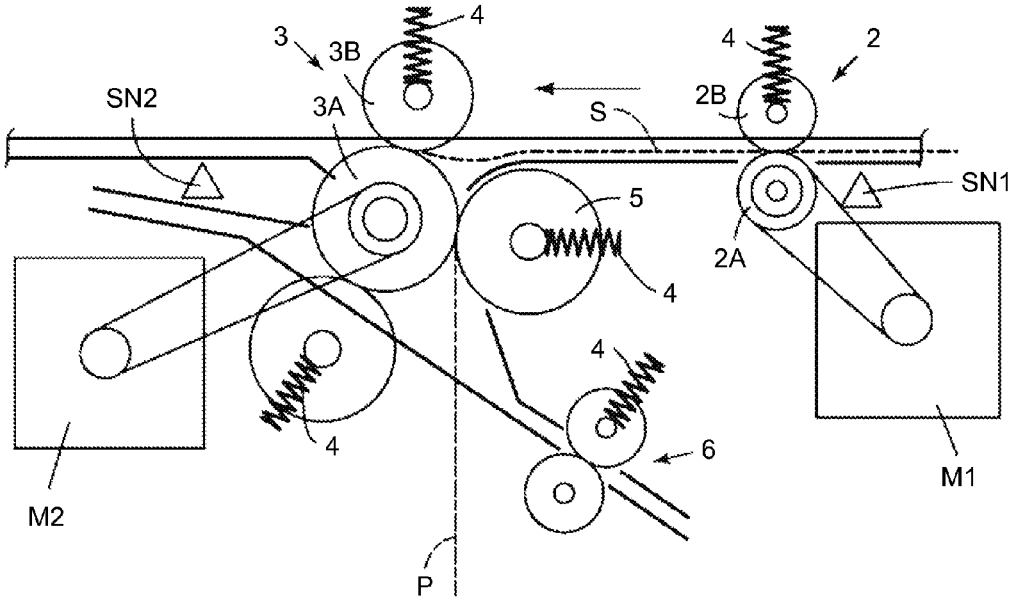
FIG. 5 is a schematic diagram for explaining an initial stage of deflection of the sheet in the sheet processing apparatus in the condition illustrated in FIG. 4.

In FIG. 4, when the sheet S is clamped and conveyed by the first conveying unit 2, as illustrated in FIG. 5, the leading end of the sheet S in the moving direction may deflect due to the curl condition and the bending stiffness of the leading end at the time the leading end reaches the second conveying unit 3.

While it is possible to prevent the deflection of the sheet S from occurring when the space of the conveying path is narrow, a certain spatial extent is needed to prevent the conveying performance from deteriorating due to an increase in sliding resistance or the like. Furthermore, in the present embodiment, the space of the conveying path that continues between the first and the second conveying units 2 and 3 is made wide for the purpose of reducing the movement resistance when the conveying direction of the sheet is switched at the time of creasing work, and thus the deflection-deformation of the sheet S is easy to occur.

Figure 6:
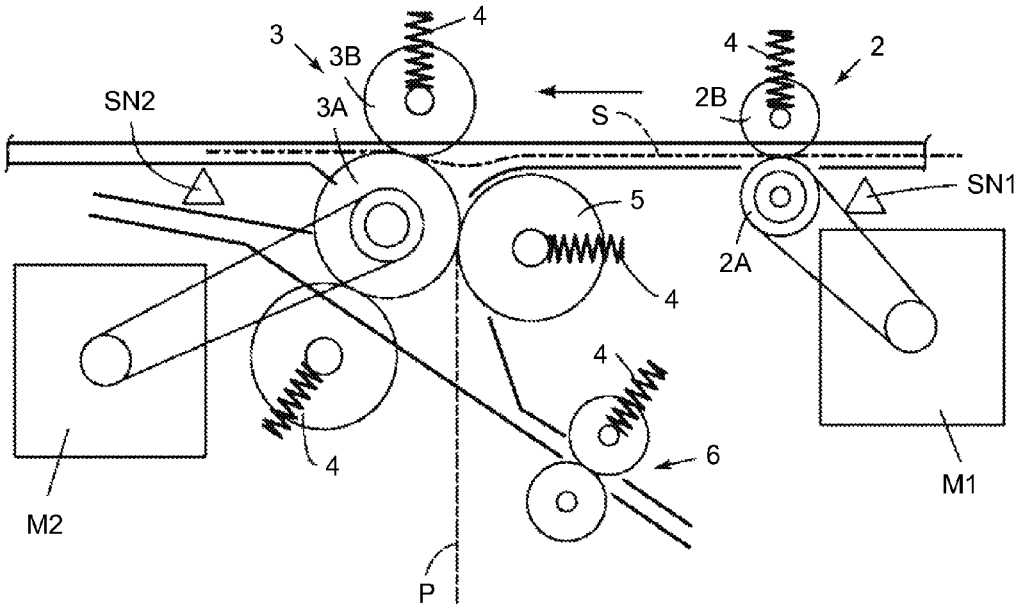
FIG. 6 is a schematic diagram illustrating a condition of the sheet being conveyed by the first conveying unit and a second conveying unit in the condition illustrated in FIG. 5 in which the deflection occurs in the sheet.

The sheet S with the deflection is conveyed, as illustrated in FIG. 6, with the deflection remaining even in the course of the leading end thereof being clamped and conveyed by the second conveying unit 3.

Figure 7:
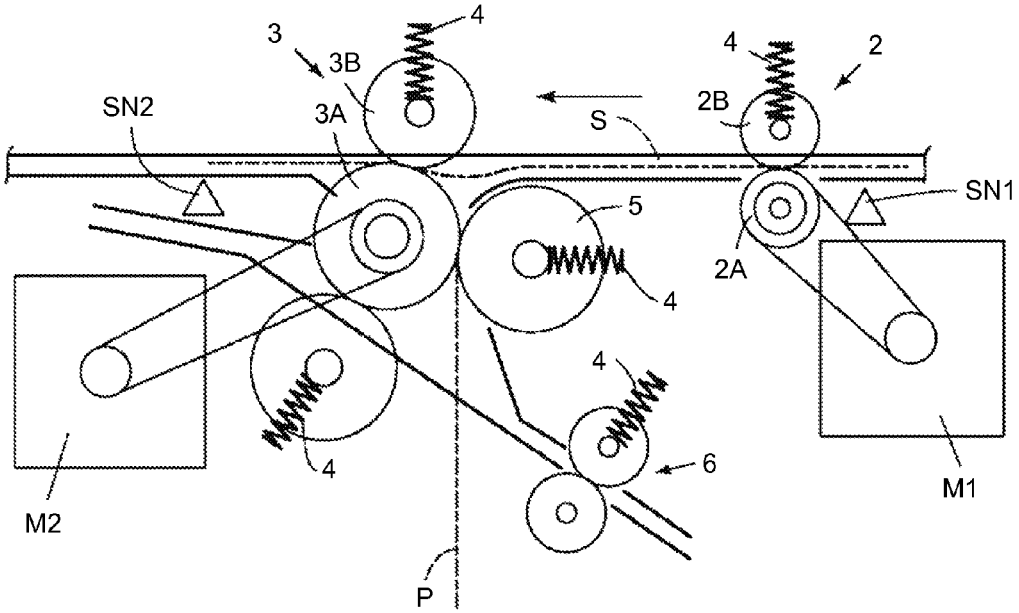
FIG. 7 is a schematic diagram illustrating a condition of the sheet when the sheet in the condition illustrated in FIG. 6 is detected by a second sheet detecting unit.

When the trailing end of the sheet S in the moving direction is detected by the first sheet detecting unit SN1, as illustrated in FIG. 7, the conveyance of the sheet S is stopped.

When the deflection occurs in this way, the amount of deflection differs depending on the curl condition and the bending stiffness of the sheet and thus, when the creasing is performed by rotating the second conveying unit 3 in reverse in the condition illustrated in FIG. 7, the creasing positions of the sheets may not match with one another due to the difference in the amount of deflection.

The present embodiment performs the control that can eliminate the deflection regardless of the difference in the amount of deflection.

The following describes the content of the control. The distance between the disposed positions of the first and the second sheet detecting units SN1 and SN2 is defined as L1 (mm), and the passing time when the sheet moves the distance at a constant speed (V1) is defined as T1 (s).

From the detection timings (T1, T2) of the first and the second sheet detecting units, the actual moving distance L2 (mm) of the sheet S can be obtained by the following expression.

$$L2=(T2-T1)\times V1$$

When no deflection of the sheet S occurs, the actual moving distance L2 equals to the reference distance L1. Meanwhile, when deflection occurs, the relation of L1 and L2 is represented as L1<L2.

Thus, the controller 200 calculates the difference between the actual moving distance L2 and the reference distance L1 as the amount of deflection (L3 (mm)), and sets the amount of rotation according to the amount of deflection as the moving amount in the direction opposite to the conveying direction, i.e., the amount of reverse rotation, for the first conveying unit 2.

Figure 8:
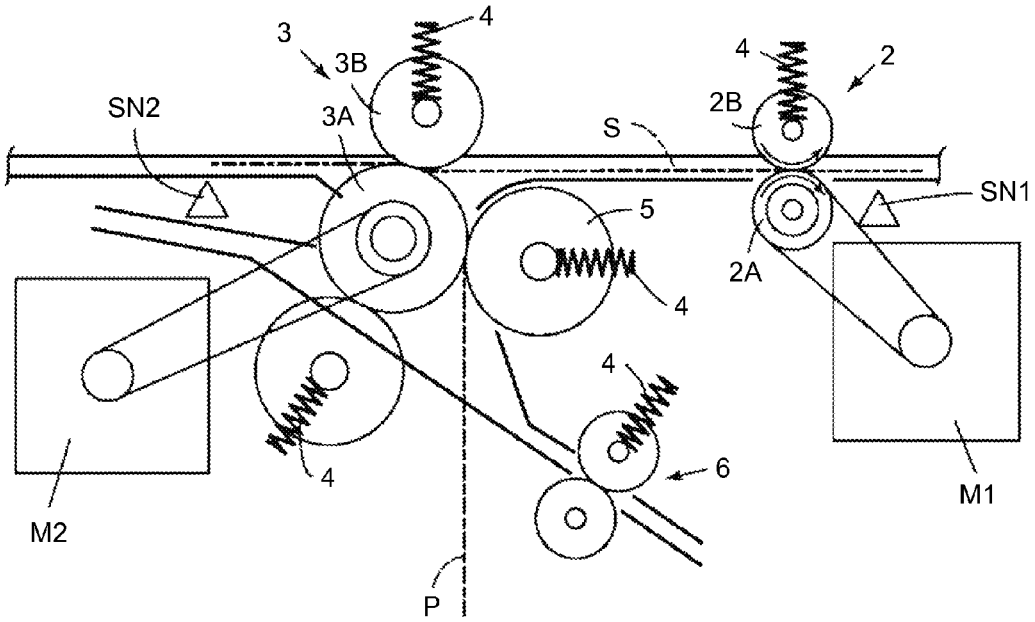
FIG. 8 is a schematic diagram illustrating a condition in which the deflection of the sheet in the condition illustrated in FIG. 7 is eliminated.

Consequently, when the first conveying unit 2 rotates in reverse, as illustrated in FIG. 8, the sheet S is pulled and stretched in the direction opposite to the conveying direction by the first conveying unit 2 while the sheet S is clamped by the second conveying unit 3, and thus the deflection is to be eliminated.

Figure 9:
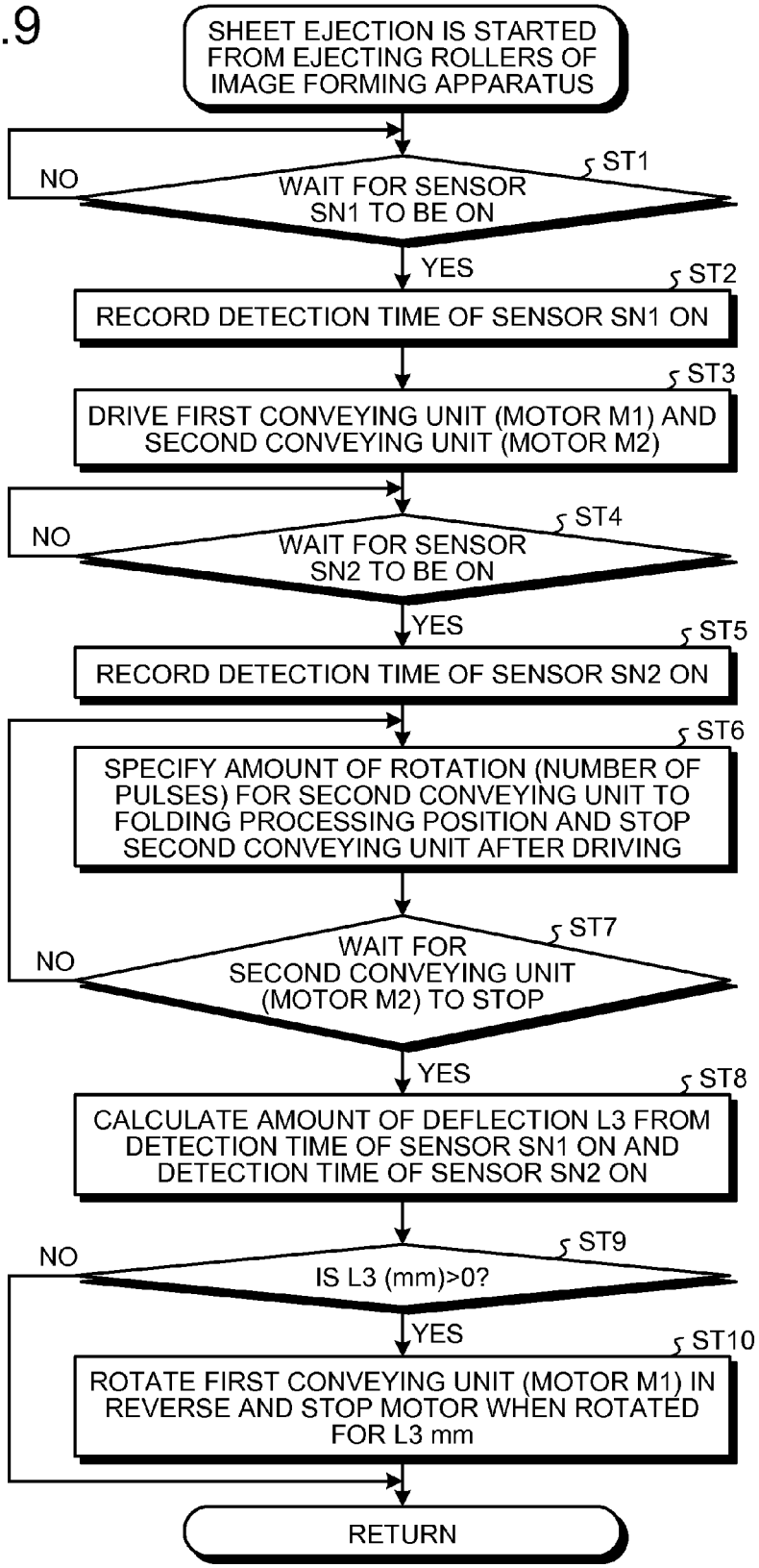
FIG. 9 is a flowchart for explaining the operation performed in the controller illustrated in FIG. 3.

The present embodiment is configured as in the foregoing, and the following explains the operation of the controller 200 with reference to the flowchart illustrated in FIG. 9. In FIG. 9, the first and the second sheet detecting units SN1 and SN2 are referred to as sensors.

When the sheet is ejected from the image forming apparatus 101, the first sheet detecting unit SN1 is turned from a detection standby condition to the condition in which whether the sheet is detected can be determined (ST1).

When the passing of the sheet S is detected by the first sheet detecting unit SN1, the controller 200 records the detection timing (ST2).

When the passing of the sheet S is detected by the first sheet detecting unit SN1, the controller 200 starts driving the first and the second conveying units 2 and 3 (ST3).

When the sheet S is conveyed by the first conveying unit 2, the second sheet detecting unit SN2 is turned from a detection standby condition to the condition in which whether the sheet is detected can be determined (ST4).

When the passing of the sheet S is detected by the second sheet detecting unit SN2, the controller 200 records the detection timing (ST5).

Based on the signal from the second sheet detecting unit SN2, the controller 200 does not stopping the second conveying unit 3 immediately, but performs the control of continuing rotation thereof for the feeding amount of the sheet corresponding to the distance from the end portion of the sheet to the creasing position and then stopping the second conveying unit 3 (ST6). This allows the sheet S to be introduced into the creasing conveying path P (see FIG. 2) when the second conveying unit 3 is rotated in reverse.

The controller 200 determines whether the rotation stop time of the second conveying unit 3 is reached (ST7), and when the rotation stop is determined, the controller 200 calculates the actual moving distance (L2) of the sheet S based on the sheet passing timings detected using the first and the second sheet detecting units SN1 and SN2. The actual moving distance (L2) and the reference distance (L1) are compared. When the result of the comparison is L1<L2, the amount of deflection is calculated by L2−L1=L3 (ST8, ST9).

When the amount of deflection (L3) results, the controller 200 sets the amount of reverse rotation for the first conveying unit 2 to pull the sheet S in the direction opposite to the conveying direction, and then makes the first conveying unit 2 stop at the time the amount of reverse rotation of the first conveying unit 2 is reached (ST10).

As a consequence, the deflection of the sheet S is eliminated, and thus the creasing positions of the sheets can be positioned at the same position.

Meanwhile, when skew correction is performed, the amount of deflection that occurs due to the skew correction is known in advance, and thus the value of the amount of deflection required for the skew correction added to the reference distance (L1) is compared with the actual moving distance (L2).

Figure 10:
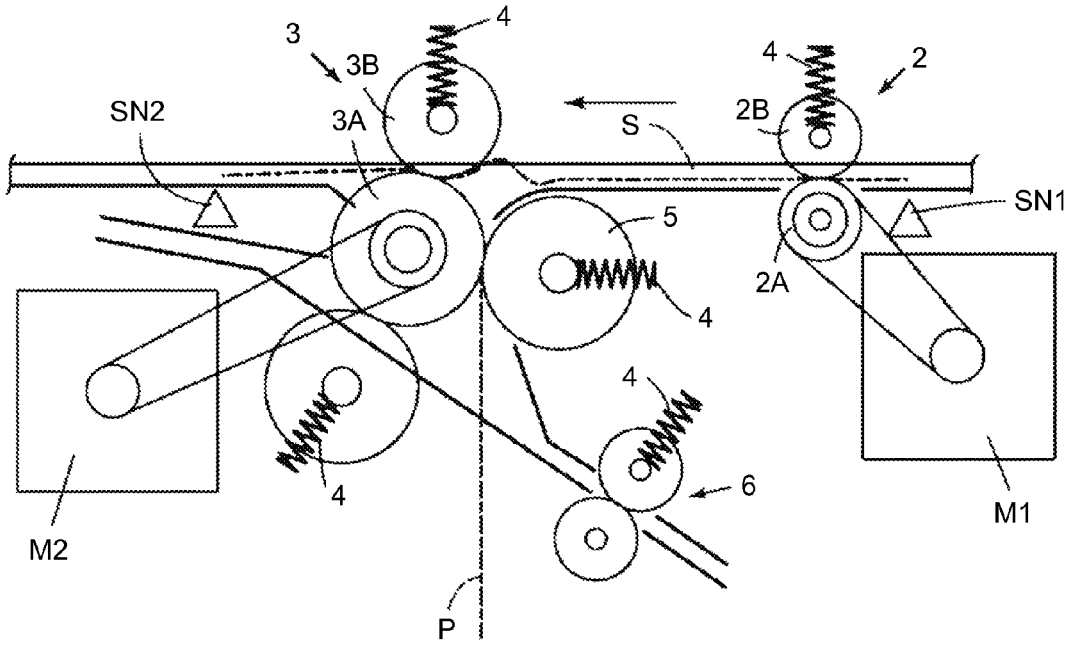
FIG. 10 is a schematic diagram illustrating the condition of the sheet when skew correction is performed in the sheet processing apparatus illustrated in FIG. 2.

FIG. 10 illustrates the occurrence of deflection when the skew correction is performed.

As illustrated in FIG. 10, when the skew correction is performed, the deflection of the sheet is greater than the deflection due to the above-described cause.

The controller 200 then compares the distance L1 (mm) between the disposed positions of the first and the second sheet detecting units SN1 and SN2 plus the amount of deflection (L4 (mm)) required for the skew correction as the reference distance with the actual moving distance (L2) of the sheet S.

When the actual moving distance (L2) is computed, the amount of deflection (L3 (mm)) is calculated by L3=L2−(L1+L4).

When the amount of deflection (L3) is calculated, the controller 200 sets the amount of reverse rotation for the first conveying unit 2.

As in the foregoing, even when the skew correction is performed, the amount of deflection of the sheet S can be calculated, and thus the deflection can be eliminated, whereby the creasing positions of the skew corrected sheets S are matched with one another.

In the present embodiment, the detection signal from the second sheet detecting unit SN2 is used as an activation signal, what is called a trigger signal, for the post-processing apparatus 102 that is the downstream apparatus. More specifically, the second sheet detecting unit SN2 is used as a member that sets the operation start time for the downstream apparatus when the sheet is conveyed by the second conveying unit 3. As a consequence, differently from when the post-processing apparatus 102 is always operated, the energy conservation can be achieved.

While the pulling force to the sheet, which is generated when the first conveying unit 2 is rotated in reverse, is used as a way to eliminate the deflection of the sheet in the above-described embodiment, the embodiment is not restricted to this way. For example, it is also possible to vary the speed of the first conveying unit 2 with respect to the speed in sheet conveyance, more specifically, to use the control of decelerating in such an extent that the pulling force to the sheet S is generated.

The present embodiment moves the first conveying unit in the opposite direction according to the result of the amount of deflection calculated by comparing the reference timings when the sheet should pass the disposed positions of the first and the second sheet detecting units with the actual passing timings, and thus the deflection of the sheet can be eliminated.

Particularly, because the control can be made based on the actual amount of deflection of the sheet, the creasing positions can be accurately matched with each other with a simple configuration regardless of the curl condition (magnitude of curl) and the bending stiffness of the leading end of the sheet of paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first conveying unit that includes a pair of members to convey a sheet;

a second conveying unit that includes a pair of members to receive the sheet conveyed by the first conveying unit and conveying the sheet to a subsequent stage;

a folding processing unit that folds the sheet by rotating the second conveying member in a reverse direction in a condition in which the sheet is held by the first conveying member and the second conveying member;

a first detecting unit that is disposed upstream of the first conveying member in a sheet conveying direction and detects an end portion of the sheet;

a second detecting unit that is disposed downstream of the second conveying member in the sheet conveying direction and detects an end portion of the sheet;

a calculating unit that calculates an amount of deflection of the sheet held by the first conveying member and the second conveying member from timings at which the sheet is detected by the first detecting unit and the second detecting unit and a distance between disposed positions of the first detecting unit and the second detecting unit; and a control unit that sets, from the calculated amount of deflection of the sheet, an amount of conveyance for the first conveying member in a direction opposite to the sheet conveying direction in a condition in which the sheet is held by the first conveying member and the second conveying member.

2. The sheet processing apparatus according to claim 1, wherein the first conveying unit is a member that conveys sheets ejected from an apparatus positioned upstream of the folding processing unit.

3. The sheet processing apparatus according to claim 1, wherein the first conveying unit moves in a direction opposite to the sheet conveying direction to eliminate deflection of the sheet that is stopped in a condition in which the sheet is clamped by the second conveying unit.

4. The sheet processing apparatus according to claim 1, wherein the control unit causes a conveying speed of the sheet by the first conveying unit to be different from a speed in conveying the sheet when the amount of deflection of the sheet is calculated.

5. The sheet processing apparatus according to claim 1, wherein the folding processing unit includes a third conveying unit that is capable of moving together with the second conveying unit, and is provided with a conveying path continuing to a conveying path from a creasing position.

6. The sheet processing apparatus according to claim 1, wherein a folding processing unit forms a conveying path in which folding work of the sheet is performed by the second conveying unit being moved to a direction opposite to the sheet conveying direction and the third conveying unit from a condition in which the sheet is clamped by stopping the conveyance of the first conveying unit and the second conveying unit.

7. The sheet processing apparatus according to claim 1, wherein the second conveying unit is a member capable of conveying the sheet to a downstream apparatus, and the second sheet detecting unit is used as a member to set an operation start time for the downstream apparatus when the sheet is conveyed to the downstream apparatus by the second conveying unit.

8. An image forming system comprising:

a sheet processing apparatus;

an image forming apparatus; and a post-processing apparatus, wherein the sheet processing apparatus comprises:

a first conveying unit that includes a pair of members to convey a sheet;

a second conveying unit that includes a pair of members to receive the sheet conveyed by the first conveying unit and conveying the sheet to a subsequent stage;

a folding processing unit that folds the sheet by rotating the second conveying member in a reverse direction in a condition in which the sheet is held by the first conveying member and the second conveying member;

a first detecting unit that is disposed upstream of the first conveying member in a sheet conveying direction and detects an end portion of the sheet;

a second detecting unit that is disposed downstream of the second conveying member in the sheet conveying direction and detects an end portion of the sheet;

a calculating unit that calculates an amount of deflection of the sheet held by the first conveying member and the second conveying member from timings at which the sheet is detected by the first detecting unit and the second detecting unit and a distance between disposed positions of the first detecting unit and the second detecting unit; and a control unit that sets, from the calculated amount of deflection of the sheet, an amount of conveyance for the first conveying member in a direction opposite to the sheet conveying direction in a condition in which the sheet is held by the first conveying member and the second conveying member, and the image forming apparatus is connected as an upstream apparatus with respect to the first conveying unit and the post-processing apparatus is connected as a downstream apparatus with respect to the second conveying unit with a position in which creasing of the sheet is performed as a boundary.

* * * * *